US006428287B1

(12) United States Patent
Denkins et al.

(10) Patent No.: US 6,428,287 B1
(45) Date of Patent: Aug. 6, 2002

(54) PORTABLE DRYWALL JOINT COMPOUND PUMP STATION

(75) Inventors: Jeffrey L. Denkins; Steven J. Mondlock, both of Kaukauna, WI (US)

(73) Assignee: Apla-Tech, Inc., Kaukauna, WI (US)

( * ) Notice: Subject to any disclaimer, the term of this patent is extended or adjusted under 35 U.S.C. 154(b) by 25 days.

(21) Appl. No.: 09/670,205

(22) Filed: Sep. 25, 2000

(51) Int. Cl.[7] ..... F04B 35/00; G01F 11/06

(52) U.S. Cl. ..... 417/360; 222/334; 222/383.1; 222/538

(58) Field of Search ..... 417/360; 222/334, 222/530, 538, 383.1, 372

(56) References Cited

U.S. PATENT DOCUMENTS 5,497,812 A 3/1996 Oroscol ..... 141/21
5,878,925 A 3/1999 Denkins et al. ..... 222/608
5,900,061 A * 5/1999 Wright ..... 118/300
6,299,686 B1 * 10/2001 Mills ..... 118/207

OTHER PUBLICATIONS

All–Wall Flyer disclosing Graco New Texspray HP System and Easy Clean® Pump, admitted prior art.

* cited by examiner

*Primary Examiner*—Charles G. Freay
(74) *Attorney, Agent, or Firm*—Andrus, Sceales, Starke & Sawall, LLP

(57) ABSTRACT

A portable drywall joint compound pump station includes a pneumatic pump for pumping joint compound from a mud container. The pump has an inlet and an outlet, and is supported by a frame at a location above the bottom of the container. An intake tube depends from the pump inlet and has an inlet port located proximate to the bottom of the container when the station is in use. A valve is provided for controlling a supply of compound air to power the pump. The frame has four legs and includes mounting brackets that are used to mount the pump to the legs such that the pump resides substantially within an imaginary peripheral surface containing outer edges of the legs to form a protective cage around the pump.

35 Claims, 8 Drawing Sheets

PORTABLE DRYWALL JOINT COMPOUND PUMP STATION

BACKGROUND OF THE INVENTION

This invention is a portable drywall joint compound pump station that pumps joint compound into drywall finishing tools and facilitates cleanup at drywall construction sites.

Drywall has become a dominant material in the construction of building interiors. In particular, building interiors generally have vertical stud walls that support pre-formed drywall panels attached to the stud walls. Joints between the adjacent drywall panels are taped and finished with joint compound before painting or wallpapering. Many drywall finishing tools have been developed over the years to facilitate taping and finishing with joint compound.

One type of drywall finishing tool is disclosed in U.S. Pat. No. 2,815,142, issuing on Dec. 3, 1957. This tool mechanically applies tape and, contemporaneously, a first coat of joint compound. This mechanical tool includes a reservoir for joint compound that needs to be filled before applying the joint compound to the drywall surface. After the tape and the first coat of joint compound have been applied over the joint, a second and sometimes even a third coat of joint compound are applied. The second and third coats are typically applied using finishing tools such as a flat box or a corner angle finishing tool. Conventional flat boxes and comer angle finishing tools also need to be filled with the joint compound.

A pneumatic apparatus for applying joint compound is disclosed in Denkins U.S. Pat. No. 5,863,146, issuing on Jan. 26, 1999. This tool also needs to be filled with joint compound before applying the joint compound to the joint between adjacent panels of drywall. The Denkins apparatus is powered by compressed air that can be easily metered to effectively control the application of joint compound. Several finishing attachments, such as heads for flat joints and corners, are removably attached to the pneumatic tool.

When working with drywall finishing tools, substantial amounts of time are spent mixing joint compound, filling application tools with joint compound, and cleaning the tools. U.S. Pat. No. 5,878,925, entitled "Drywall Joint Compound Pump Workstation," by Jeffrey L. Denkins and Steven J. Mondlock, issuing on Mar. 9, 1999, and assigned to the assignee of the present application, discloses a drywall joint compound pump workstation that is designed to accommodate these needs, as well as other needs present at drywall construction work sites. The workstation disclosed in the Denkins et al. '925 patent effectively mixes and pumps joint compound for drywall finishing tools. The pump workstation has a series of quickly interchangeable attachments and is extremely versatile. It is also designed to facilitate rinsing and cleaning of the workstation and drywall finishing tools at the work site. In its commercial embodiment, the pump workstation includes a rather large supply reservoir having an open top and a closed bottom for mixing and holding a supply of joint compound. A gravity fed pump is attached to the bottom of the supply reservoir. A transport tube is connected to the pump, and an outlet of the transport tube is positioned in the vicinity of the open top of the supply reservoir. The top of the transport tube is preferably provided with a quick-disconnect fitting so that one of several attachments can be attached to the outlet of the transport tube to facilitate the task at hand. For example, a gooseneck attachment is attached to the transport tube in order to mix and recirculate joint compound from the supply reservoir through the pump and the transport tube back into the supply reservoir. Various filling adapters are also provided at the top of the transport tube in order to fill various drywall tools, such as the mechanical tool of the type disclosed in U.S. Pat. No. 2,815,142, the pneumatic joint compound application tool as disclosed in Denkins et al. U.S. Pat. No. 5,863,146; or other tools such as flat boxes. In addition, a threaded nipple attachment is provided along with a water hose to facilitate on-site rinsing and cleaning.

In order to facilitate portability of the aforementioned workstation, the workstation is mounted on a conventional wheeled hand truck. The pump is mounted to the base of the hand truck and the supply reservoir is mounted directly above the pump so that both the pump and the supply reservoir are balanced on the hand truck. The pump is preferably a pneumatic pump that is powered by compressed air. The availability of a compressed air supply at the drywall work site is commonplace.

While the drywall joint compound pump workstation disclosed in Denkins et al. U.S. Pat. No. 5,878,925 has been commercially successful, some drywall workers feel that the station may be too expensive or too bulky for their needs. It is an object of the present invention to accommodate the needs of these drywall workers with a portable drywall joint compound pump station that is compact, reliable, and durable. The pump station should also able to fill a variety of application tools with joint compound, and facilitate the rinsing and cleaning of tools on-site.

SUMMARY OF THE INVENTION

The invention is a portable drywall joint compound pump station that uses a pneumatic pump to pump joint compound from a mud container such as a five gallon bucket or other similar container. The pneumatic pump is preferably a double diaphragm pneumatic pump. In order to use the pump station, the drywall joint compound should be pre-mixed in the container. In the preferred embodiment of the invention, the pneumatic pump is mounted to a frame having legs that support the pneumatic pump at a height above the ground such that an inlet for the pump is higher than the typical height for a five-gallon bucket. Alternatively, it may be desirable for the bottom of the legs to mount onto the container itself (see for example FIGS. 15–17).

An intake tube is connected to the pump inlet and extends downward such that the inlet port for the intake tube is positioned close to the bottom of the container when the intake tube is placed within the container (e.g., ½"–¾" above the ground surface). In order to accommodate the suction of a consistent flow of mixed drywall joint compound through the pneumatic pump, it is important that the diameter of the intake tube be sufficiently large to avoid significant restriction of the flow of joint compound through the intake tube into the pump. Preferably, the inside diameter of the intake tube is about two inches. The pump outlet preferably faces in the same direction as the pump inlet, thereby enabling the filling of tools to occur over the open top of the container. This configuration reduces messes at the work site. In the preferred embodiment of the invention, the pump station is designed to be placed adjacent a five gallon-bucket filled with pre-mixed joint compound, such that the intake tube is located within the bucket and dips in the mixture of joint compound in the bucket. The legs for the pump station are located adjacent the bucket. The pump outlet preferably includes a quick-disconnect fitting, such as a cam lever coupling, in order to facilitate the connection and removal of various accessories such as filling tubes for application tools, filling adapters for flat boxes or corner angle finishing tools, a hose adapter for a rinsing and cleaning water hose, or a recirculation tube to direct joint compound from the pump outlet downward into the bucket.

The frame for the pump station is preferably constructed of two arch-shaped, steel members. The pneumatic pump is mounted to the arch-shaped members using a pair of mounting panels in such a manner that the pair of arch-shaped members provide four legs for the pump station, as well as looped handles above the pump. The leg portions of the arch-shaped members taper slightly outward in order to render the pump station stable as it stands on the ground (or as it is mounted to the top of a larger container or tub). The pneumatic pump is mounted substantially entirely within an imaginary peripheral surface contained within the arch-shaped members. The arch-shaped members, therefore, provide a protective cage that protects the pneumatic pump from damage when the pump station is laid on its side for transportation, or if the pump station tips over accidentally.

As mentioned, it is preferred that the pump station be designed so that the filling of tools occurs over the open top of the mud container (e.g., a five-gallon bucket). In order to accomplish this task with the joint compound application tool disclosed in Denkins et al., U.S. Pat. No. 5,863,146, a filling tube with a convoluted shape and a filling adapter at its end is removably connected to the quick-disconnect fitting at the pump outlet. A brace is provided between the front legs on the frame. The brace has a notch that supports the convoluted tube when the filling port for the application tool is inserted in the filling adapter for the convoluted filling tube. In addition, a removable mast is provided at the rear of the frame for the pump station. A support bar, preferably pivotable, is connected to the mast and supports the end of drywall application tool opposite the filling port. In this manner, the filling port is located above the open top of the mud container, and also the load on the frame remains relatively balanced while the application tool is being filled. In order to fill the mechanical tool disclosed in U.S. Pat. No. 2,815,142 a convoluted filling tube having a different configuration is used. The different configuration is needed for balancing purposes because the orientation of the filling port for the application tool is different than that disclosed in Denkins et al., U.S. Pat. No. 5,863,146. In the filling tube for the mechanical tool disclosed in U.S. Pat. No. 2,815,142, it is preferred that the location of the filling adapter on the convoluted filling tube be relatively low with respect to the pump station. Also, it is preferred that a cradle for the body of the application tool be permanently connected to the convoluted filling tube. When filling this type of mechanical tool (U.S. Pat. No. 2,815,142), it is not normally desirable to use the support brace on the mast.

Under normal operating conditions, it takes approximately 7 to 10 seconds to fill either the mechanical tool of U.S. Pat. No. 2,815,142 or the pneumatic tool of U.S. Pat. No. 5,863,146 using a pneumatic pump station designed in accordance with the invention. In order to control operation of the pump station, the preferred embodiment of the invention provides a control lever to operate a spring-actuated valve mechanism that supplies compressed air to the pneumatic pump. Also preferably, a guide member is provided for the control lever. The guide member provides a catch that holds the lever to maintain the spring-actuated valve in an open position, thereby rendering the pump in continuous operation. Continuous operation is most likely to be desirable when using the pump station for rinsing and cleaning, or even sometimes for recirculation of the drywall joint compound from the mud container (e.g. bucket or tub) through the pneumatic pump and back into the mud container (e.g. bucket or tub).

It should be apparent to those skilled in the art that the invention provides an easily portable, yet effective and versatile drywall joint compound pump station. For example, in its preferred embodiment, the pump station without attachment weighs approximately 25 pounds. In addition to being relatively light, the pump station in its preferred embodiment is stable and durable. Other advantages and features of the invention should be apparent to those skilled in the art upon reviewing the drawings and the following description thereof.

DETAILED DESCRIPTION OF THE INVENTION

Figure 1:
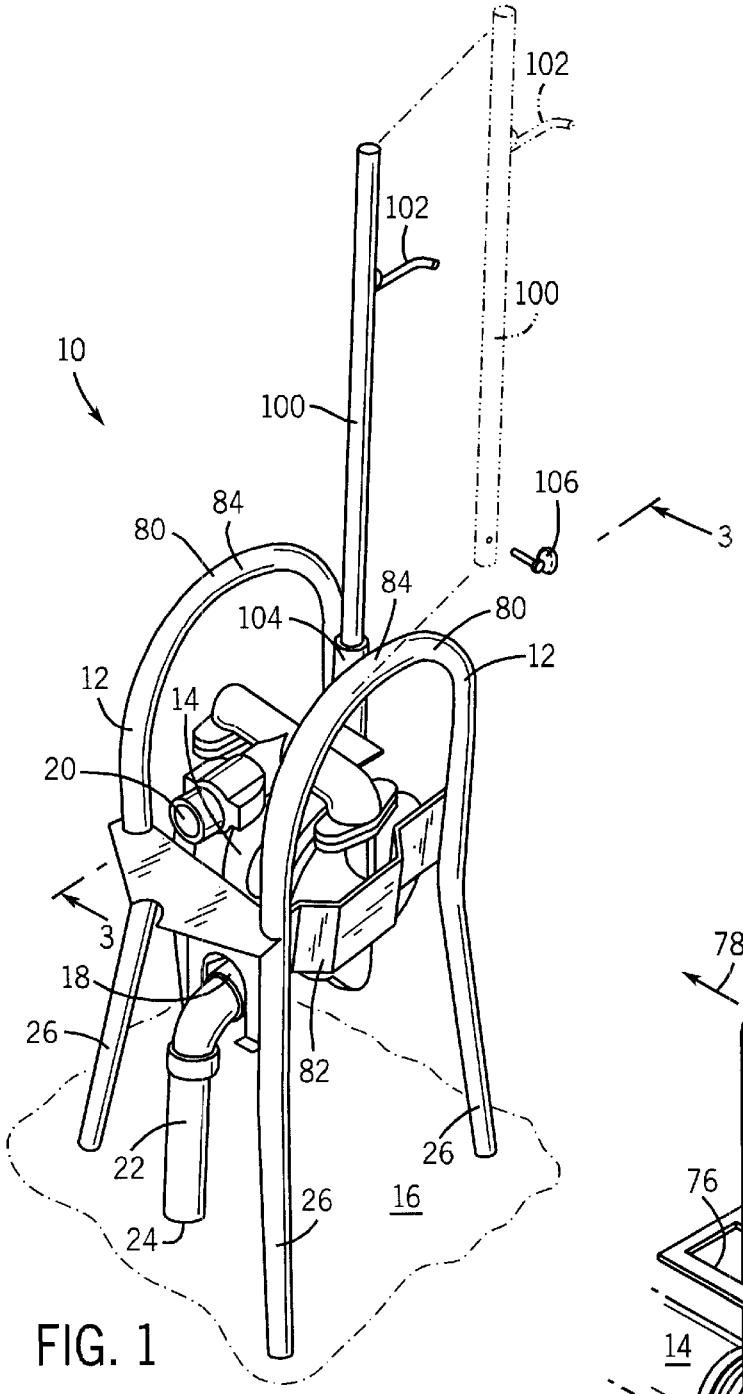
FIG. 1 is a perspective view of a portable drywall joint compound pump station constructed in accordance with a preferred embodiment of the invention.

FIG. 1 shows a portable drywall joint compound pump station 10 constructed in accordance with a preferred embodiment of the invention. The pump station 10 comprises a frame 12 that supports a pneumatic pump 14 above the ground 16. The pneumatic pump 14 has an inlet 18 and an outlet 20. An intake tube 22 depends from the pump inlet 18. The intake tube 22 has an inlet port 24 located close to the ground 16 when the pump station 10 is standing on the legs 26 of the frame 12. Preferably, the inlet port 24 is located approximately ½ to ¾ of an inch above the ground surface when the pump station 10 is in operation. In operation, the portable drywall joint compound pump station 10 is preferably placed adjacent a mud container (e.g., bucket 28 in FIG. 3) containing drywall joint compound. For example, the intake tube 22 is located inside of the bucket 28 and dips into joint compound located within the bucket 28 and the legs 26 of the frame 12 are placed on the ground floor 16 outside of the bucket 28. In some circumstances, however, it may be desirable to use a larger tub or the mud container. When a larger tub is used or a mud container, it may be desirable to place the pump station 10 entirely within the tub.

Figure 3:
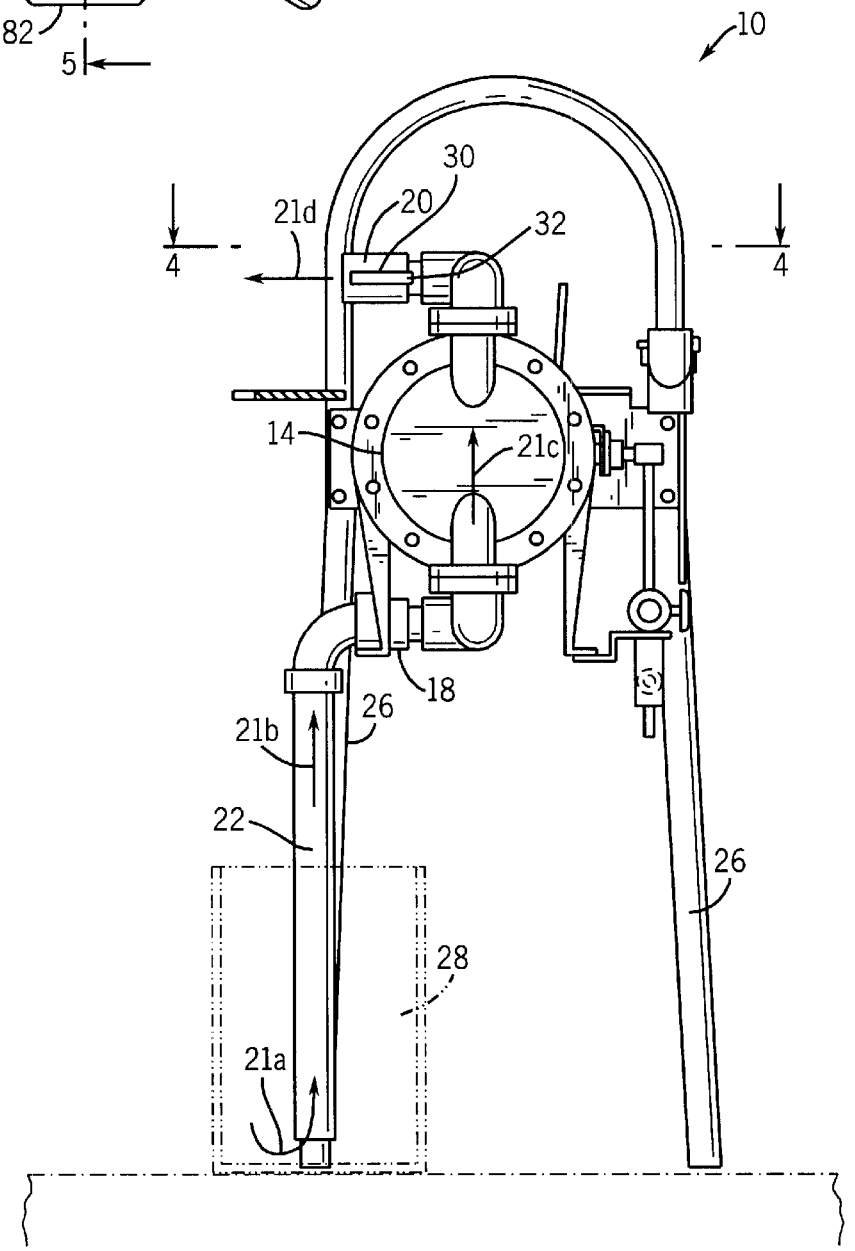
FIG. 3 is a side elevational view of a portable drywall joint compound pump station constructed in accordance with the preferred embodiment of the invention.

Referring to FIG. 3, pre-mixed drywall joint compound located in the bucket 28 is sucked upward from the bucket 28 through the intake tube 22 and into the pump inlet 18 when the pneumatic pump 14 is operating. The pneumatic pump 14 pumps the joint compound through the pump outlet 20. The flow of drywall joint compound from the bucket 28, through the intake tube 22 and the pump 14 is depicted by arrows 21*a*, 21*b*, 21*c*, 21*d* in FIG. 3.

The pump 14 is preferably a pneumatically driven, suction-type, double diaphragm pump that is manufactured by Arrow Corporation of Brian, Ohio, Model No. 66610X-X-C. It is important that the pump 14 have sufficient pumping capability to consistently pump drywall joint compound, which can on occasion can become relatively stiff as it sits in the bucket 28. Even immediately after mixing, drywall joint compound normally has a consistency such that the joint compound is not pourable. Drywall joint compound must be relatively thick for the joint compound to be useful. The thick consistency, however, provides resistance to suction through the intake tube 22 and the pump 14. The preferred pump is a one-inch, double diaphragm pump. This pneumatic pump 14 has sufficient suction power to ensure consistent operation of the pump station 10, yet it is also important that the inside diameter of the intake tube 22 be sufficiently large to allow consistent flow of the non-pourable drywall compound when the pneumatic pump 14 is operating. Preferably, the inside diameter of the intake tube 22 is approximately two inches. Testing has shown that an inside diameter of two inches is sufficient for ensuring adequate flow to the pump 14 even after drywall joint compound sits idle in the bucket 28 for a reasonable amount of time.

Referring to FIGS. 1 and 3, the outlet 20 for the pump 14 preferably faces in the same direction with respect to the pump 14 as the intake tube 22. Note that the pump outlet 20 is preferably located directly above the intake tube 22. As shown in FIG. 3 (and in FIGS. 9, 10, 11, 12 and 13), the pump outlet 20 is provided with a quick disconnect fitting 30. The quick disconnect fitting 30 is preferably a cam lever coupling such as the type commercially manufactured by Tara Products of Crawfordsville, Indiana and sold under the Banjo™ trademark. Each coupling 30 includes a pair of pivotally mounted arms 32 having eccentrically shaped cam surfaces. Each of the adapters 34*a*, 36*a*, 38*a*, 40*a*, 42*a* on the accessories 34, 36, 38, 40, 42 preferably includes a circumferential rim that extends deep into the outlet coupling 30, and is secured by the cam surfaces on the arms 32 within the coupling 30 when the arms 32 are closed. The accessories 34, 36,38, 40, 42 can be easily removed by opening the arms 32 and detaching the accessory.

Figure 5:
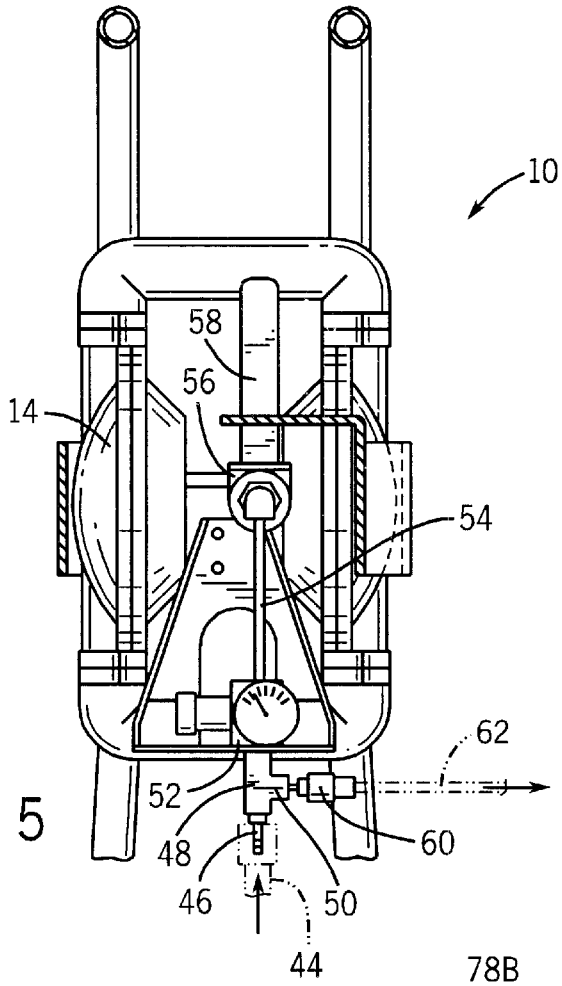
FIG. 5 is a sectional view taken along line 5—5 in FIG. 4.

Referring to FIG. 5, compressed air is supplied to the pump 14 through compressed air hose 44. The compressed air hose 44 supplies compressed air to the pump 14 from a compressed air source, such as a conventional compressor which is typically available at the job site. The pump station 10 includes a nipple fitting 46 to which the compressed air hose 44 is removably attached. Compressed air is provided through the nipple fitting 46 into a compressed air manifold 48. The compressed air manifold 48 includes the inlet nipple fitting 46, a compressed air supply port 50, and a pressure regulator 52. Optionally, the compressed air manifold 48 may also include an air filter (not shown). From the pressure regulator 52, compressed air is supplied through pneumatic supply line 54 to a valve 56 having a spring-loaded control lever 58. The pressure regulator 52 is provided because compressed air pressure at job sites is often inconsistent. The pressure of the compressed air exiting from the pressure regulator 52 should be consistent with the needs for the pneumatic pump 14, and in the preferred embodiment, is approximately 60 through 90 psi.

The compressed air supply port 50 is provided with a quick release fitting 60 that enables the connection of a compressed air supply line 62 directly from the pump station 10. Such a compressed air supply line 62 is desirable, for example, when a worker desires to operate a texture gun using the pump station 10.

Figure 6:
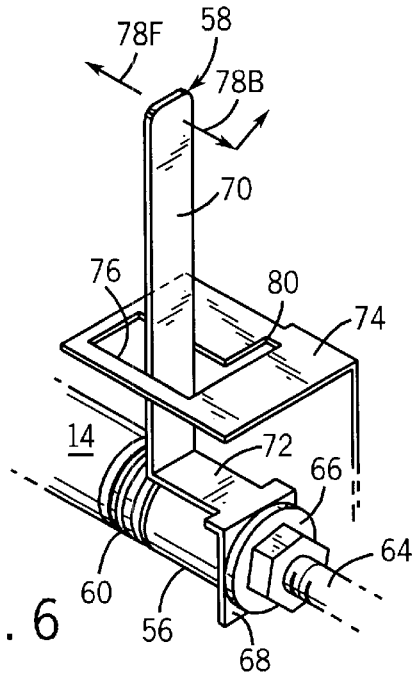
FIG. 6 is a detailed view of a spring-loaded valve actuating mechanism, which is a component of preferred embodiment of the invention.
Figure 7:
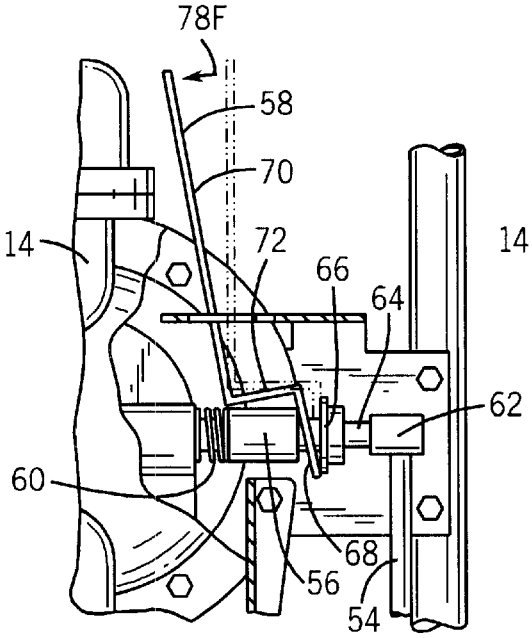
FIGS. 7 and 8 show the operation of the spring-actuated valve mechanism shown on FIG. 6.
Figure 8:
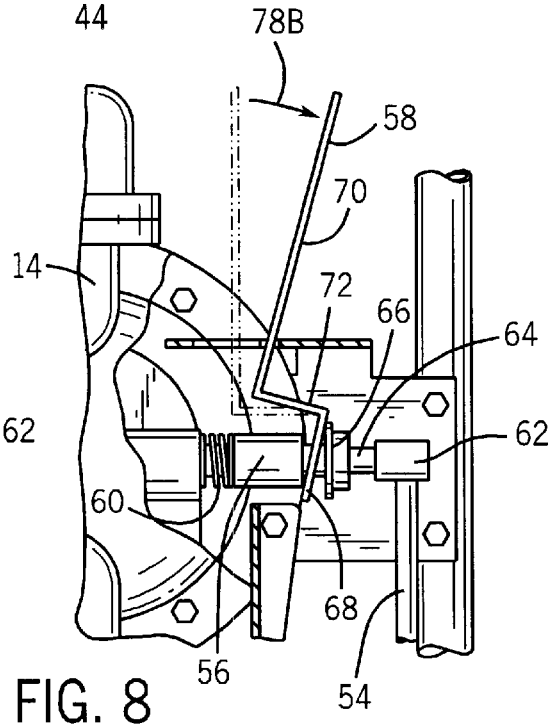

Referring now to FIGS. 6–8, compressed air is supplied to the pneumatic pump 14 only when it is desired to pump either joint compound or water through the pump 14. The supply of compressed air to the pump 14 is controlled by valve 56. the valve 56 has a valve body 56 that is preferably spring biased in a closed position by spring 60. More specifically, compressed air in line 54 is supplied to an elbow fitting 62. From elbow fitting 62, compressed air is supplied through supply line 64. A collar 66 is mounted around the outside of the supply line 64. Pneumatic valve 56 is installed in-line with supply line 64 downstream of the collar 66. When the body of the pneumatic valve 56 is in an open position (towards the left in FIGS. 7 and 8), compressed air is allowed to flow through lines 54 and 64 to the pump 14. When the body of the pneumatic valve 56 is moved to the closed position (as shown in FIG. 6 and towards the right in FIGS. 7 and 8), compressed air power is not supplied to the pump 14. The biasing spring 60 is mounted around the supply line 64 between the housing of the pump 14 and the movable body of the pneumatic valve 56. Because the spring is compressed, the spring 60 biases the body of the valve 56 into the closed position (i.e., towards the right in FIGS. 7 and 8). A control lever 58 is provided to move the valve body 56 and open the pneumatic valve 56. The control lever 58 includes a leveraging plate 68, a handle 70, and an intermediate stepped portion 72 connecting the handle 70 to the leveraging plate 68.

Referring now in particular to FIG. 6, the leveraging plate 68 includes a hole (not shown) through which the supply line 64 passes. The leveraging plate 68 is mounted around line 64 such that the leveraging plate 68 fits between the collar 66 and the movable body of the pneumatic valve 56. In FIG. 6, the position of the handle 70 of the control lever 58 is in the neutral or closed position. As mentioned, in the neutral or closed position, the spring 60 biases the movable body of the pneumatic valve 56 away from the pump 14 and against the leveraging plate 68 and the collar 66. A guide member 74 is provided for guiding and controlling the position of the handle 70 of the control lever 58. The guide member 74 is preferably a plate of sheet metal or the like that is fixed to either the pump 14 or the frame 12 in a fixed position. The guide member 74 contains a slot 76 through which the handle 70 of the control lever 58 is able to move in order to open and close the pneumatic valve 56. Note that it is desirable for the slot 76 to be configured and located such that the handle 70 of the control lever 58 can move either forward or backward as depicted by arrows 78*b* and 78*f*. In addition, the guide member 74 is also provided with a notch 80 adjacent one end of the longitudinal slot 76. The notch 80 provides a catch that holds the handle 70 of the control lever 58 when the handle is moved in the direction of arrow 78*b* and rotated into the notch 80. The control lever 58 is sufficiently rigid so that movement of the handle 70 either forward (78*f*) or backward (78*b*) causes the leveraging plate 68 to push the movable valve body 56 away from the fixed collar 66 against the tension of the spring 60. When the handle 70 is locked in the fully backward position by catch 80, compressed air is supplied to the pump 14 continuously. In normal operation when the station 10 is used to fill tools, it is not preferred that the pneumatic valve 56 be locked in the open position. Locking the valve 56 in the open position is, however, preferable when cleaning or rinsing tools with water, or occasionally when it is desirable to recirculate drywall joint compound from the mud container through the pump and back into the mud container.

Referring again to FIG. 1, the frame 12 is preferably constructed from a pair of tubular arch-shaped members 80, each with a mounting plate 82 mounted horizontally between the legs 26 of the respective arch-shaped member 80. Each side of the pump 14 is bolted to the respective mounting plate 82, preferably using the same holes that are provided by the pump manufacturer for bolting together the housing of the diaphragm pump 14.

Figure 4:
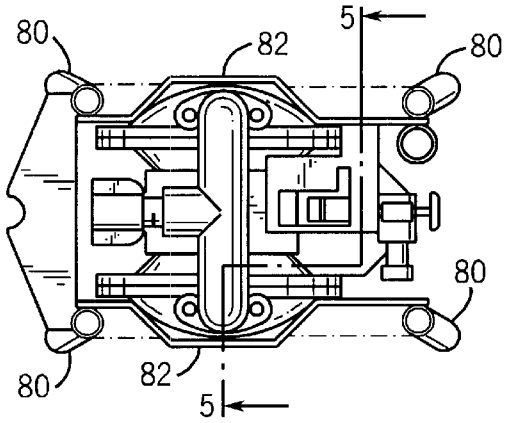
FIG. 4 is a view taken along line 4—4 in FIG. 3.

The legs 26 (i.e., the bottom portion of each arch-shaped member 80) flair outward away from each other as the legs 26 extend downward. In this manner, the legs 26 provide a stable support for the pump 14 even under heavy working conditions. Furthermore, the top portion 84 of the arch-shaped members 80 provide handles for lifting the portable pump station 10. Also, as shown in FIG. 1 and the sectional view of FIG. 4, the tubular arch-shaped members 80 and the flat mounting plates 82 preferably provide a protective cage for the other components of the pump station 10. In other words, the pneumatic pump 14, and most of the components that are permanently attached to the pneumatic pump 14, reside substantially within an imaginary peripheral surface defined by the location of the arch-shaped members 80. In this manner, the pump station 10 is protected in case it tips over, or so that it can be laid down on its side for transportation, etc.

Figure 2:
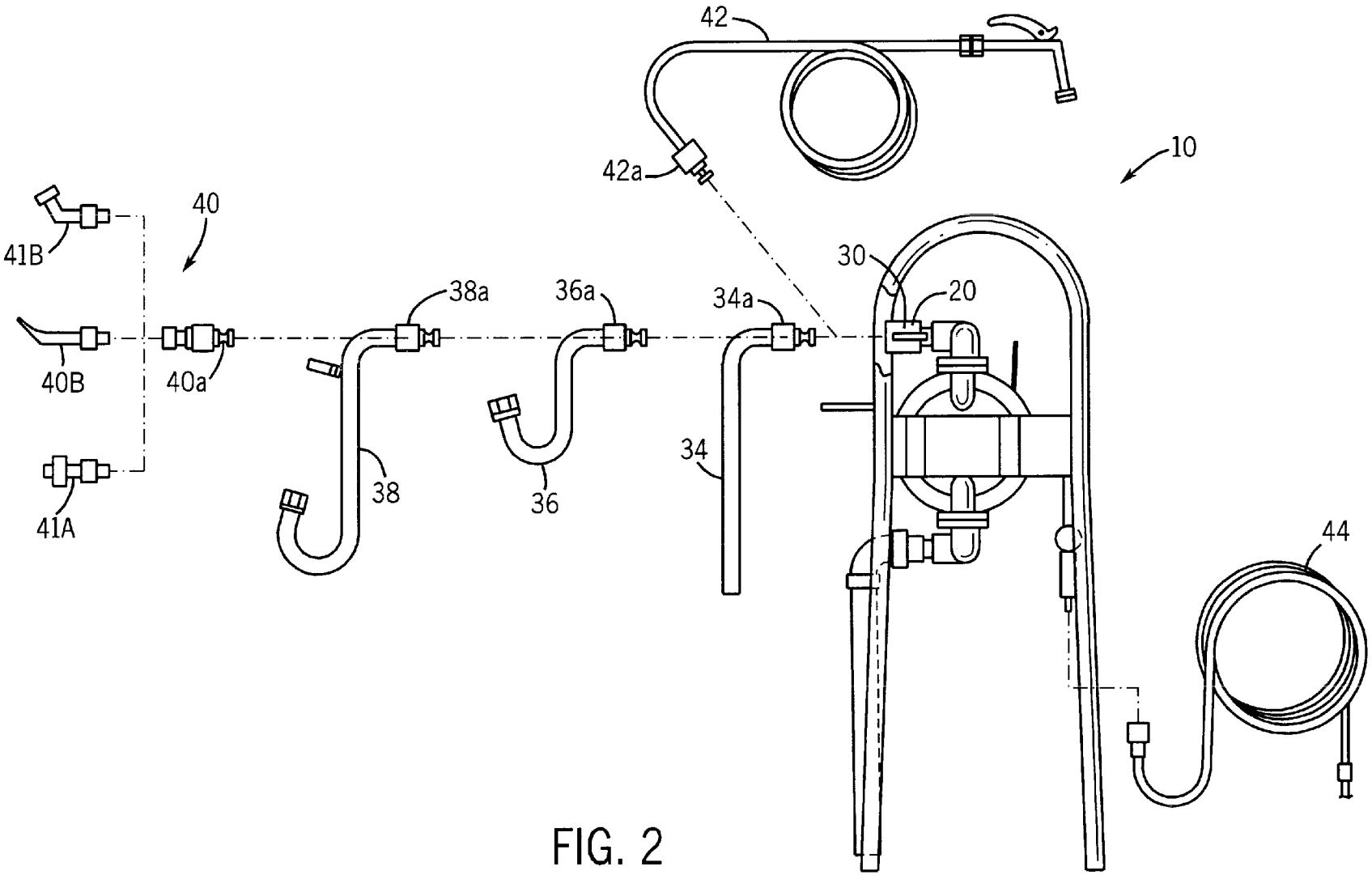
FIG. 2 is a schematic view illustrating the pump workstation shown in FIG. 1 along with various detachable accessories for filling drywall finishing tools and rinsing and cleaning of such tools.
Figure 9:
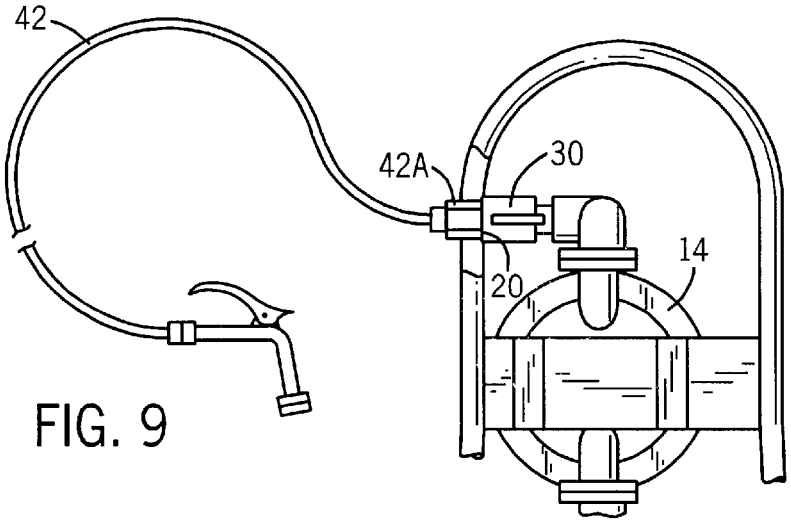
FIG. 9 is a schematic view showing the attachment of a hose to the pump outlet as in accordance with the preferred embodiment of the invention.

Referring to FIG. 2, the system 10 preferably includes numerous detachable accessories including a detachable recirculation tube 34, detachable filling tubes 36, 38, detachable filling adapter 40, and a detachable water hose 42. FIG. 9 shows the water hose 42 connected to the outlet 20 of the pump 14. Water should be contained in the mud container (e.g. bucket 28) when the water hose 42 is connected to the pump 14.

Figure 10:
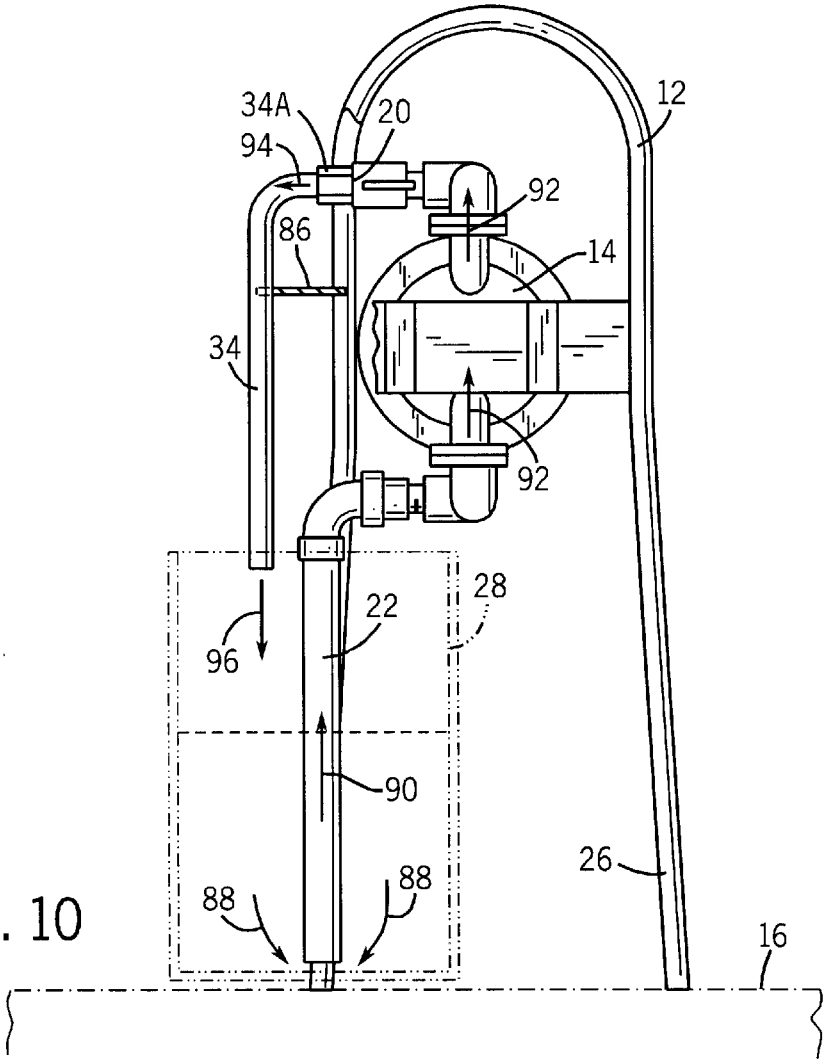
FIG. 10 is a schematic view showing the attachment of a recirculation tube to the pump outlet as in accordance with the preferred embodiment of the invention.

FIG. 10 shows a recirculation tube 34 connected to the outlet 20 of the pump 14. A brace 86 helps to support the recirculation tube 34 against the frame 12. In order to recirculate drywall joint compound in the bucket 28, drywall joint compound is sucked into the intake tube 22 (arrows 88), up through the intake tube (arrow 90), through the pump 14 (arrows 92), and discharged through the pump outlet 20 into the recirculation tube 34 (arrow 94), and eventually returned to the bucket 28 (arrow 96).

Figure 11:
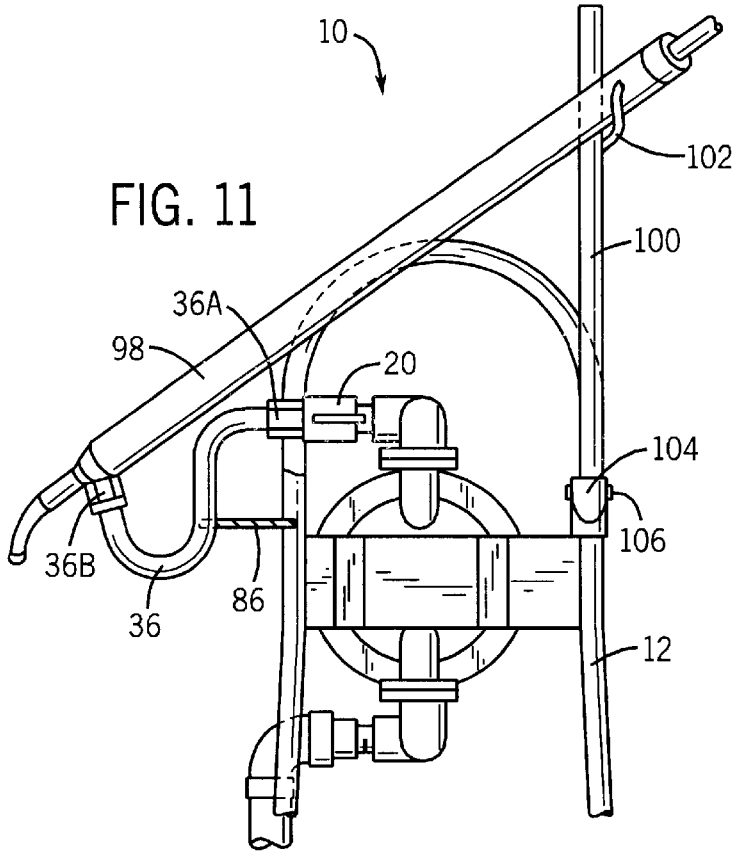
FIG. 11 is a schematic drawing showing the attachment of a convoluted filling tube to the pump outlet in order to fill a pneumatic tool of the type shown in Denkins et al. U.S. Pat. No. 5,863,146, as in accordance with the preferred embodiment of the invention.

FIG. 11 shows filling tube 36 connected to the outlet 20 of the pump 14. The filling tube 36 includes an adapter 36*b* which is designed to fit the filling port of drywall application tool 98. Drywall application tool 98 shown in FIG. 11 is a pneumatically powered application tool as disclosed in Denkins U.S. Pat. No. 5,863,146 issued on Jan. 26, 1999. Note that the pneumatic application tool 98 has significant length. In order to hold the tool 98, the station 10 is provided with a removable mast 100. As shown in both FIGS. 1 and 11, the mast 100 includes a pivotable arm 102. A stop is provided between the mast 100 and the pivotable arm 102 so that the pivotable arm does not pivot beyond a perpendicular orientation with the mast 100. The end of the pneumatic tool 98 is supported on the pivotable arm 102 as shown in FIG. 11. The arm 102 is pivotable so that the arm 102 can be pivoted into alignment with the mast 100 when the mast 100 is not in use. The removable mast 100 is attachable to the station frame 12 by way of a receiving collar 104. A pin 106 locks the mast 100 into the collar 104.

Figure 12:
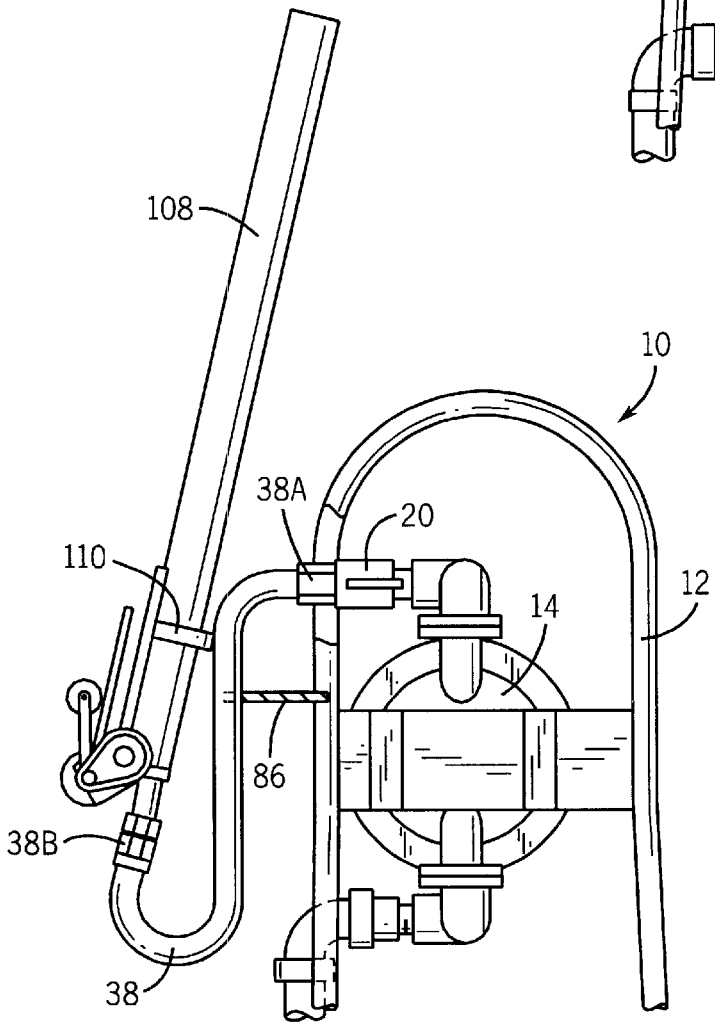
FIG. 12 is a schematic view showing the attachment of a convoluted filling tube to the pump outlet in order to fill a tool of the type disclosed in U.S. Pat. No. 2,815,142, as in accordance with the preferred embodiment of the invention.

FIG. 12 shows a different filling tube 38 connected to the outlet 20 of the pump 14. The filling tube 38 includes a filling adapter 38*b* which is designed to accept the filling port on application tool 108. The application tool 108 shown in FIG. 12 is a drywall finishing tool as disclosed in U.S. Pat. No. 2,815,142 which issued on Dec. 3, 1957. Note that the station 10 does not use the mast to fill tool 108. Rather, the filling tube 38 itself includes a holding brace 110 to hold the body of the filling tool 108.

Figure 13:
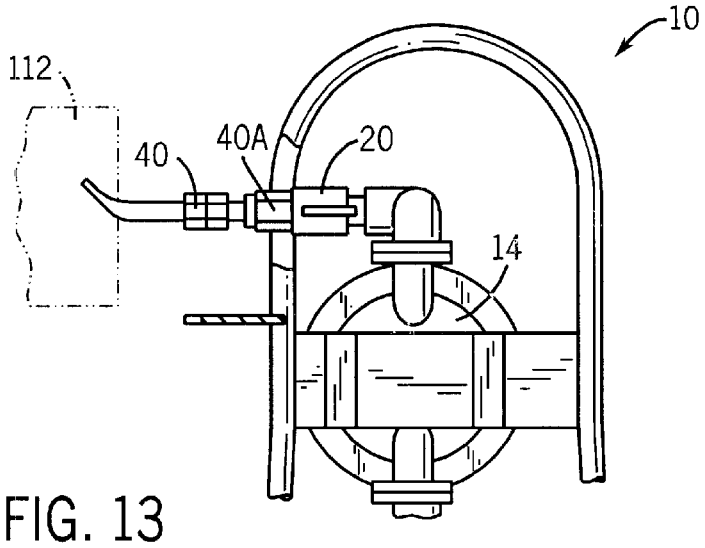
FIG. 13 is a schematic view showing the pump station with a flat box filling adapter attached to the pump outlet as in accordance with the preferred embodiment of the invention.

FIG. 13 shows filling tool 40 connected to the outlet 20 of the pump 14. Filling tool 40 is shown in FIG. 13 as filling a flat box 112. Referring to FIG. 2, it is preferred that the spout 40*b* of the filling tool 40 be removable from the adapter 40A for the flat box filling tool 40. In this manner, other attachments, such as 41*a* or 41*b*, can be attached to the adapter 40*a*. Alternatively, the adapter 40A can be used to directly fill certain tools, such as a corner angle finishing tool.

Figure 14:
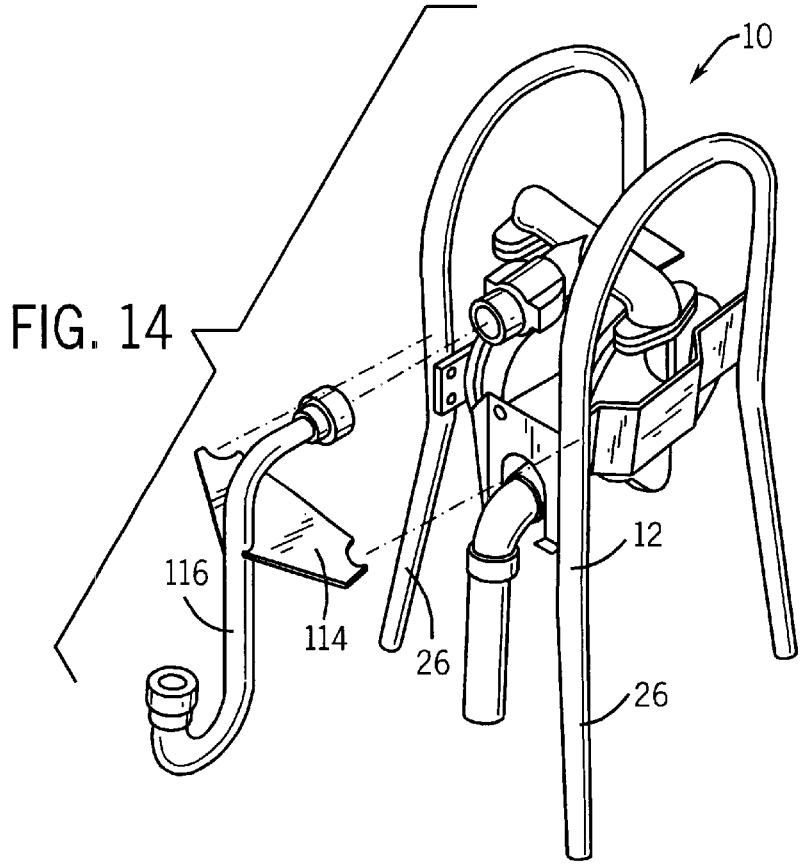
FIG. 14 is an expanded isometric view illustrating another embodiment of the invention in which a brace for supporting a convoluted filling tube is attached to the convoluted filling tube rather than to the frame of the pump station.

FIG. 14 shows a slightly different embodiment of the station 10 in which brace 114 is connected to filling tube 116, rather than to the frame 12. Note that the brace 114 contains curved notches to receive the legs 26 on the frame 12.

Figure 16:
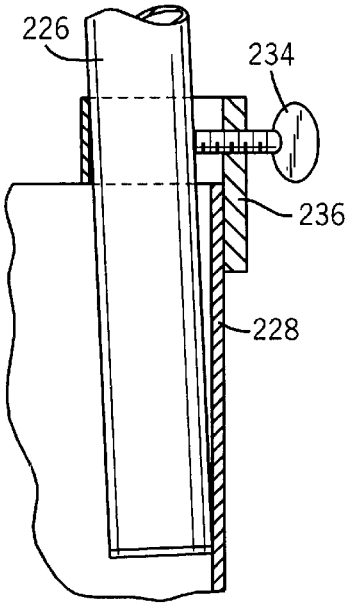
FIG. 16 is a sectional view taken along line 16—16 in FIG. 15.
Figure 15:
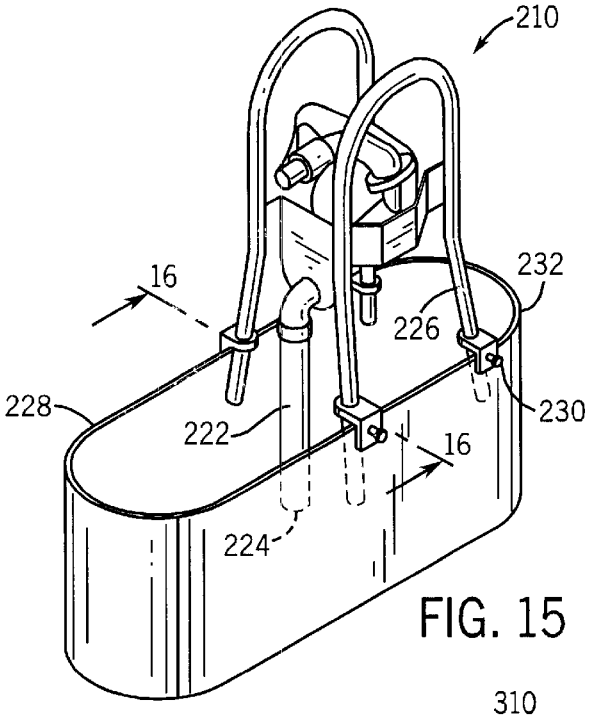
FIG. 15 is a perspective view of a drywall joint compound pump station constructed in accordance with another embodiment of the invention.
Figure 18:
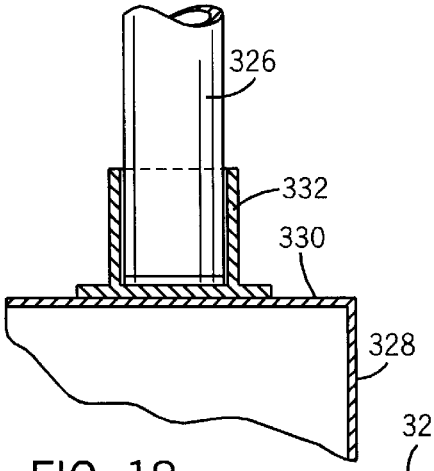
FIG. 18 is a detailed sectional view taken along line 18—18 in FIG. 17.

FIGS. 15–18 show two embodiments 210, 310 of the drywall joint compound pump station in which the legs 226, 326 are not supported on the ground. Rather, the legs 226, 326 are supported by the mud container 228, 328, respectively. In FIG. 15, the legs 226 on the station 210 are supported by brackets 230 mounted to an upper rim 232 of the mud container 228. Note that the brackets 230 include a set screw or some other mechanism which allows the legs 226 to be easily tightened into the brackets 230 so that the station 210 can be removed from the mud container 228. FIG. 16 is a detailed view showing screw 234 securing a leg 226 in an associated bracket 236 on the mud container 228. The configuration shown in FIGS. 15 allows the use of a mud container 228 with significantly more capacity than the five-gallon bucket shown in the embodiment described with respect to FIGS. 1–14. As with the earlier embodiment shown in FIGS. 1–14, it is still desirable that the intake opening 224 at the bottom of the intake tube 222 be located in relatively close proximity to the bottom of the mud container 228.

Figure 17:
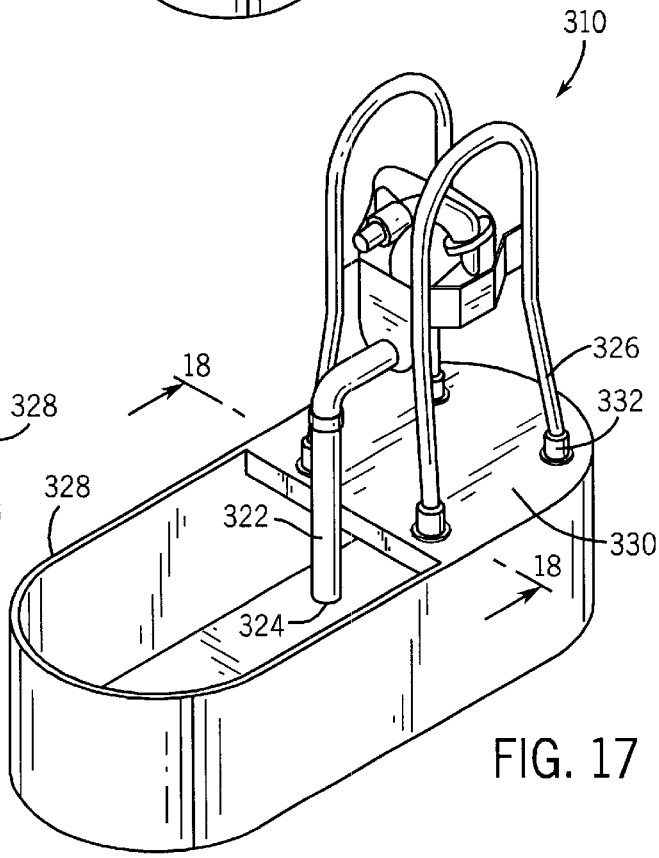
FIG. 17 is a perspective view of a drywall joint compound pump station constructed in accordance with yet another embodiment of the invention.

The embodiment 310 shown in FIG. 17 is similar to the embodiment 210 shown in FIG. 15, except that the mud container 328 in FIG. 17 includes an upper platform 330 for supporting the station 310. More specifically, foot holders 332 are affixed to the top surface of the upper platform 330. The legs 326 are set into the foot holders 332 to hold the station 310 in place on top of the upper platform 330. The intake tube 322 extends outward and downward from the pump and the platform into the mud container 328 containing drywall joint compound. As in the other embodiments, it is desirable that the bottom opening 324 of intake tube 322 be located in close proximity to the bottom of the mud container 328.

Various alternatives and other embodiments are contemplated as being within the scope of the following claims which particularly point out and distinctly claim the subject matter regarded as the invention.

We claim:

1. A portable drywall joint compound pump station comprising:

a frame;

a pneumatic pump for pumping joint compound from an open mud container, wherein the pneumatic pump has a pump inlet and a pump outlet disposed directly over the open mud container and is supported by the frame at a location above a top of the open mud container;

an intake tube depending from the pump inlet and having an intake tube inlet port located proximate to the bottom of the mud container when the station is in use, the diameter of intake tube being sized to allow suction of a flow of non-pourable drywall joint compound upward from the mud container through the intake tube to the pump inlet when the pneumatic pump is operating; and a valve for controlling a supply of compressed air to power the pneumatic pump, wherein the frame has four legs and the frame further comprises mounting brackets that are used to mount the pneumatic pump to the legs such that the pneumatic pump resides substantially within an imaginary peripheral surface containing outer edges of the legs to form a protective cage around the pump.

2. A portable drywall joint compound pump station as recited in claim 1 wherein the intake tube inlet port opens in a downward direction.

3. A portable drywall joint compound pump station as recited in claim 1 wherein the pneumatic pump is a double-diaphragm type pneumatic pump and the inside diameter of the intake tube is approximately two inches.

4. A portable drywall joint compound pump station as recited in claim 1 wherein the pump inlet is located on a front side of the pneumatic pump, and the pump outlet is also located on the front side of the pneumatic pump.

5. A portable drywall joint compound pump station as recited in claim 1 further comprising a filling tube that is connected to the pump outlet and is used to fill a drywall finishing tool.

6. A portable drywall joint compound pump station as recited in claim 5 wherein the pump outlet and the filling tube are each provided with mating quick-disconnect fittings.

7. A portable drywall joint compound pump station as recited in claim 6 wherein the quick-disconnect fitting on the pump outlet is a cam lever coupling.

8. A portable drywall joint compound pump station as recited in claim 5 wherein the filling tube comprises of a convoluted tube having an outlet located in a position in front of the pump outlet and at a height below the pump outlet;

and a filling adapter connected to an outlet of the convoluted tube in which a filling port on a drywall finishing tool is received.

9. A portable drywall joint compound pump station as recited in claim 8 further comprising:

a brace located beneath the pump outlet, the brace comprising a notch that retains the convolused tube and supports the convoluted tube when a filling port on a drywall finishing tool is mounted in the filling adapter of the convoluted filling tube in order to fill the finishing tool with drywall joint compound.

10. A portable drywall joint compound pump station as recited in claim 8 further comprising:

a detachable mast that extends vertically upward from a rear portion of the frame; and a support bar that is attached to the detachable mast;

wherein the support bar cradles the finishing tool and supports the finishing tool at least in part when the finishing tool is mounted in the filling adapter on the outlet of the filling tube in order to fill the finishing tool with drywall joint compound.

11. A portable drywall joint compound pump station as recited in claim 10 wherein the support bar is pivotally mounted to the detachable mast.

12. A portable drywall joint compound pump station as recited in claim 8 wherein the filling tube further comprises:

a support cradle attached to the convoluted tube to retain the finishing tool when the filling port on the finishing tool is mounted in the filling adapter on the convoluted filling tube in order to fill the finishing tool with drywall joint compound.

13. A portable drywall joint compound pump station as recited in claim 1 further comprising a recirculation tube that is removably connected to the pump outlet.

14. A portable drywall joint compound pump station as recited in claim 13 wherein both the pump outlet and the recirculation tube are provided with mating quick-disconnect fittings.

15. A portable drywall joint compound pump station as recited in claim 14 wherein the quick-disconnect fitting on the pump outlet is a cam lever coupling.

16. A portable drywall joint compound pump station as recited in claim 1 further comprising a filling adapter for a corner-angle finishing tool that is removably connected to the pump outlet.

17. A portable drywall joint compound pump station as recited in claim 1 further comprising a flat box filling adapter that is removably connected to the pump outlet.

18. A portable drywall joint compound pump station as recited in claim 17 wherein the filling adapter for the flat box has a removable filling tube so that the filling adapter converts into a filling adapter for a comer-angle finishing tool.

19. A portable drywall joint compound pump station as recited in claim 1 wherein the frame comprises a pair of arch-shaped members mounted generally parallel to each other to form four legs and a pair of handles for the pump station, the handles being located above the pneumatic pump.

20. A portable drywall joint compound pump station as recited in claim 1 further comprising a spring-loaded pneumatic valve actuator and a control lever that controls the valve and operation of the pneumatic pump.

21. A portable drywall joint compound pump station as recited in claims further comprising:

a guide member for the control level, the guide member containing a slot through which the control lever moves in order to open and close the valve, and also a catch that holds the control lever in a position in which the valve is open and the pneumatic pump is operating.

22. A portable drywall joint compound pump station as recited in claim 8 wherein a brace member is attached to the convoluted tube, and the brace member comprises a pair of notches for receiving the frame legs and supporting the filling tube when a filling port on a drywall finishing tube is mounted in the filling adapter of the filling tube in order to fill the finishing tube with drywall joint compound.

23. A portable drywall joint compound pump station as recited in claim 1 wherein the frame has legs that support the station on the ground and the intake tube inlet port is located proximate to the ground when the station is standing on the legs.

24. A portable drywall joint compound pump station comprising:

a frame;

a pneumatic pump for pumping joint compound from a mud container, wherein the pneumatic pump has a pump inlet and a pump outlet and is supported by the frame at a location above a bottom of the mud container, the pump outlet having a quick-disconnect fitting;

an intake tube connected to the pump inlet and having an intake tube inlet port located proximate to the bottom of the mud container when the station is in use; and a valve for controlling a supply of compressed air to power the pneumatic pump;

a recirculation tube having a quick-disconnect fitting that mates with the quick-disconnect fitting for the pump outlet and is intended to be removably connected to the quick-disconnect fitting for the pump outlet; and a water hose having an adapter with a quick-disconnect fitting that mates with the quick-disconnect fitting for the pump outlet and is intended to be removably connected to the quick-disconnect fitting of the pump outlet, wherein the frame has four legs and the frame further comprises mounting brackets that are used to mount the pneumatic pump to the legs such that the pneumatic pump resides substantially within an imaginary peripheral surface containing outer edges of the legs to form a protective cage around the pump.

25. A portable drywall joint compound pump station as recited in claim 24 further comprising a first filling tube that is configured to fill a first type of drywall finishing tool and is removably connectable to the quick-disconnect fitting of the pump outlet.

26. A portable drywall joint compound pump station as recited in claim 25 further comprising a second filling tube that is configured to fill a second type of drywall finishing tool and is also removably connectable to the quick-disconnect fitting at the pump outlet.

27. A portable drywall joint compound pump station as recited in claim 26 further comprising a first filling adapter that is configured to fill a third type of drywall finishing tool and is removably connectable to the quick-disconnect fitting at the pump outlet.

28. A portable drywall joint compound pump station as recited in claim 27 further comprising a second filling adapter that is configured to fill a fourth type of drywall finishing tool and is removably connectable to the quick-disconnect fitting of the pump outlet.

29. A portable drywall joint compound pump station as recited in claim 24 wherein the legs support the station on the ground and the intake tube inlet port is located proximate to the ground when the station is standing on the legs.

30. A portable drywall joint compound pump station comprising:

a frame having leg structure that supports the station on the ground;

a pneumatic pump for pumping joint compound from an open container having sidewall structure, wherein the pneumatic pump has a pump inlet and a pump outlet and is supported by the frame at a location above the ground;

an intake tube depending from the pump inlet and having an intake tube inlet port located proximate to the ground when the station is standing on the legs, the diameter of intake tube sized large to allow flow of non-pourable drywall joint compound upward from the container through the intake tube to the pump inlet when the pneumatic pump is operating; and a valve for controlling a supply of compressed air to power the pneumatic pump, wherein the leg structure has four legs and the frame further comprises mounting brackets that are used to mount the pneumatic pump to the legs such that the pneumatic pump resides substantially within an imaginary peripheral surface containing outer edges of the legs to form a protective cage around the pump, and wherein the legs are disposed either inside or outside the sidewall structure of the open container.

31. A portable drywall joint compound pump station comprising:

a frame;

a pneumatic pump for pumping joint compound from a mud container, wherein the pneumatic pump has a pump inlet and a pump outlet and is supported by the frame at a location above a bottom of the mud container;

an intake tube depending from the pump inlet and having an intake tube inlet port located proximate to the bottom of the mud container when the station is in use, the diameter of intake tube being sized to allow suction of a flow of non-pourable drywall joint compound upward from the mud container through the intake tube to the pump inlet when the pneumatic pump is operating;

a valve for controlling a supply of compressed air to power the pneumatic pump;

a filling tube that is connected to the pump outlet and is used to fill a drywall finishing tool, wherein the filling tube is comprised of a convoluted tube having an outlet located in a position in front of the pump outlet and at a height below the pump outlet, and a filling adapter is connected to the outlet of the convoluted tube in which a filling port on a drywall finishing tool is received; and a brace located beneath the pump outlet, the brace comprising a notch that retains the convoluted tube and supports the convoluted tube when the filling port on the drywall finishing tool is mounted on the filling adapter of the convoluted filling tube in order to fill the finishing tool with drywall joint compound.

32. A portable drywall joint compound pump station comprising:

a frame;

a pneumatic pump for pumping joint compound from a mud container, wherein the pneumatic pump has a pump inlet and a pump outlet and is supported by the frame at a location above a bottom of the mud container;

an intake tube depending from the pump inlet and having an intake tube inlet port located proximate to the bottom of the mud container when the station is in use, the diameter of intake tube being sized to allow suction of a flow of non-pourable drywall joint compound upward from the mud container through the intake tube to the pump inlet when the pneumatic pump is operating;

a valve for controlling a supply of compressed air to power the pneumatic pump;

a filling tube that is connected to the pump outlet and is used to fill a drywall finishing tool, wherein the filling tube is comprised of a convoluted tube having an outlet located in a position in front of the pump outlet and at a height below the pump outlet, and a filling adapter is connected to the outlet of the convoluted tube in which a filling port on a drywall finishing tool is received;

a detachable mast that extends vertically upward from a rear portion of the frame; and a support bar that is pivotally attached to the detachable mast;

wherein the support bar cradles the finishing tool and supports the finishing tool at least in part when the finishing tool is mounted in the filling adapter on the outlet of the filling tube in order to fill the finishing tool with drywall joint compound.

33. A portable drywall joint compound pump station comprising:

a frame;

a pneumatic pump for pumping joint compound from a mud container, wherein the pneumatic pump has a pump inlet and a pump outlet and is supported by the frame at a location above a bottom of the mud container;

an intake tube depending from the pump inlet and having an intake tube inlet port locate proximate to the bottom of the mud container when the station is in use, the diameter of intake tube being sized to allow suction of a flow of non-pourable drywall joint compound upward from the mud container through the intake tube to the pump inlet when the pneumatic pump is operating; and a valve for controlling a supply of compressed air to power the pneumatic pump, wherein the frame has four legs and the frame further comprises mounting brackets that are used to mount the pneumatic pump to the legs such that the pneumatic pump resides substantially within an imaginary peripheral surface containing outer edges of the legs to form a protective cage around the pump.

34. A portable drywall joint compound pump station comprising:

a frame;

a pneumatic pump for pumping joint compound from a mud container, wherein the pneumatic pump has a pump inlet and a pump outlet and is supported by the frame at a location above a bottom of the mud container;

an intake tube depending from the pump inlet and having an intake tube inlet port located proximate to the bottom of the mud container when the station is in use, the diameter of intake tube being sized to allow suction of a flow of non-pourable drywall joint compound upward from the mud container through the intake tube to the pump inlet when the pneumatic pump is operation; and a valve for controlling a supply of compressed air to power the pneumatic pump, wherein the frame comprises a pair of arch-shaped members mounted generally parallel to each other to form four legs and a pair of handles for the pump station, the handles being located above the pneumatic pump.

35. A portable drywall joint compound pump station comprising:

a frame;

a pneumatic pump for pumping joint compound from a mud container, wherein the pneumatic pump has a pump inlet and a pump outlet and is supported by the frame at a location above a bottom of the mud container;

an intake tube depending from the pump inlet and having an intake tube inlet port located proximate to the bottom of the mud container when the station is in use, the diameter of intake tube being sized to allow suction of a flow of non-pourable drywall joint compound upward from the mud container through the intake tube to the pump inlet when the pneumatic pump is operating;

a valve for controlling a supply of compressed air to power the pneumatic pump; and a filling tube that is connected to the pump outlet and is used to fill a drywall finishing tool, wherein the filling tube is comprised of a convoluted tube having an outlet located in a position in front of the pump outlet and at a height below the pump outlet, and a filling adapter is connected to the outlet of the convoluted tube in which a filling port on a drywall finishing tool is received, wherein the frame has four legs and the frame further comprises mounting brackets that are used to mount the pneumatic pump to the legs such that the pneumatic pump resides substantially within an imaginary peripheral surface containing outer edges of the legs to form a protective cage around the pump, and wherein a brace member is attached to the convoluted tube, and the brace member comprises a pair of notches for receiving the frame legs and supporting the filling tube when a filling port on a drywall finishing tube is mounted in the filling adapter of the filling tube in order to fill the finishing tube with drywall joint compound.

* * * * *